US011719000B2

(12) United States Patent
Nurmi

(10) Patent No.: US 11,719,000 B2
(45) Date of Patent: Aug. 8, 2023

(54) FACADE CLADDING FASTENING SYSTEM AND METHOD FOR FASTENING FACADE AND ADJUSTING MEMBER

(71) Applicant: Muotolevy Oy, Nummela (FI)

(72) Inventor: Esa Nurmi, Kauniainen (FI)

(73) Assignee: Muotolevy Oy, Nummela (FI)

( * ) Notice: Subject to any disclaimer, the term of this patent is extended or adjusted under 35 U.S.C. 154(b) by 302 days.

(21) Appl. No.: 17/078,786

(22) Filed: Oct. 23, 2020

(65) Prior Publication Data

US 2022/0290441 A1 Sep. 15, 2022

(30) Foreign Application Priority Data

Oct. 25, 2019 (EP) ..... 19205389

(51) Int. Cl.
*E04F 13/08* (2006.01)

(52) U.S. Cl.
CPC ..... *E04F 13/0808* (2013.01)

(58) Field of Classification Search
CPC ..... E04F 13/0805; E04F 13/0808; E04F 13/0807
See application file for complete search history.

(56) References Cited

U.S. PATENT DOCUMENTS 10,260,240 B1 * 4/2019 Bilge ..... E04F 13/0807
2020/0256063 A1 * 8/2020 Franklin ..... E04F 13/12

FOREIGN PATENT DOCUMENTS

EP 0236224 A1 9/1987
EP 2647780 A2 * 10/2013 ..... E04F 13/0807
FR 2826390 A1 12/2002
FR 2969679 A1 * 6/2012 ..... E04F 13/0807
FR 3002255 A1 * 8/2014 ..... E04F 13/0807
FR 3034443 A1 10/2016

OTHER PUBLICATIONS

Extended European Search Report in Application No. EP19205389, dated Apr. 4, 2020.

* cited by examiner

*Primary Examiner* — Christine T Cajilig
(74) *Attorney, Agent, or Firm* — Brooks Kushman PC; John E. Nemazi

(57) ABSTRACT

A façade cladding fastening system having at least two first profiles arranged to be fastened to the wall of a building, at least two second profiles fastened to the first profiles, wherein the second profile is fastened to the first profile with an adjusting member, wherein the adjusting member, having a central axis perpendicular to the first and second profiles, is configured to slide along the first profile and/or the second profile for adjusting the position of the second profile in relation to the first profile, and move along its central axis for adjusting the distance between the first and the second profile.

16 Claims, 7 Drawing Sheets

FACADE CLADDING FASTENING SYSTEM AND METHOD FOR FASTENING FACADE AND ADJUSTING MEMBER

CROSS-REFERENCE TO RELATED APPLICATIONS

This application claims foreign priority benefits under 35 U.S.C. §119(*a*)-(*d*) to EP application 19205389.0, filed Oct. 25, 2019, the disclosure of which is hereby incorporated by reference in its entirety.

TECHNICAL FIELD

The present invention relates to facade cladding fastening systems and methods for fastening a façade .

BACKGROUND

A façade is generally exterior side of a building and it is often the most important aspect from a design standpoint. It may also have functional meaning as it impacts for example on energy efficiency and covers the building structures from its surrounding environment, e.g. weather.

Façade claddings, as interior and exterior finishing materials of buildings, are processed for example in a rectangular plate shape, and they are usually closed with a certain distance from the outer wall typically in parallel with the outer wall of the building.

In known systems, a bracket is fixed to the wall and for example a profile or such is fastened to the bracket. Then a façade cladding is mounted, e.g. by screws, on the profile. Since a fixing member, such as a metal profile, for each cladding is mounted on a concrete structure of a building, i.e. wall, it is difficult to correct the position when the fixing members are mounted at a wrong position. Further, the building structures, like walls, may not have planar surfaces, but the surface has some roughness. Thus, it is difficult to adjust the cladding positions so that the façade forms straight and even surface. To overcome this problem, the outer surface of the building wall needs to be leveled and/or smoothened somehow, which is time and money consuming.

OBJECTIVE OF THE INVENTION

The objective of the system is to alleviate the disadvantages mentioned above.

In particular, it is an objective of the present system to provide a façade cladding fastening system, in which the cladding position may be adjusted in three dimensions. Another objective is to provide a method for aligning a façade cladding.

SUMMARY

According to a first aspect, the present invention provides a façade cladding fastening system comprising, at least two first profiles arranged to be fastened to the wall of a building, at least two second profiles fastened to the first profiles. The second profile is fastened to the first profile with an adjusting member, wherein the adjusting member, having a central axis perpendicular to the first and second profiles, is configured to slide along the first profile and/or the second profile for adjusting the position of the second profile in relation to the first profile, and move along its central axis for adjusting the distance between the first and the second profile.

Advantage of the system is that façade cladding fastening is much faster because there is no need to even or condition the surface of a building wall in which the façade is installed. The system allows adjustment in three dimensions so that the installation is more flexible and immune to the irregularity of the surface of the wall.

In an embodiment of the system, the first profile comprises a C-rail portions extending towards the second profile.

In an embodiment of the system, the adjusting member comprises a flange provided between the first and second profile.

In an embodiment of the system, the adjusting member comprises an adjusting portion having threads engaged with first profile flanges of the C-rail portions of the first profile, and it is configured to move along its central axis when it is rotated around the central axis.

In an embodiment of the system, the adjusting member is made of plastic.

In an embodiment of the system, the first profile and the second profile are made of different material.

In an embodiment of the system, the first and second profile are made of metal.

In an embodiment of the system, the position of the second profile is locked by a locking member configured to be installed through the second profile into the adjusting member, through the second profile and through the adjusting member into the first profile, or through the second profile and through the adjusting member into a locking piece arranged inside the first profile.

In an embodiment of the system, at least one spacer is arranged between the adjusting member and the second profile, wherein the spacer comprises a flange portion, arranged to support the second profile, and a base portion, engaged with the adjusting member.

According to a second aspect a method is provided for fastening a façade cladding to the wall of a building, comprising steps of:

fastening at least two first profiles to the wall of a building, engaging adjusting members to the first profile, fastening with the adjusting members at least two second profiles to the first profiles, adjusting the position of the second profiles in relation to the first profiles by sliding the adjusting members along the first profiles, adjusting the distance of the second profiles from the first profiles by moving the adjusting member along its central axis, fastening at least one façade cladding to the second profiles.

In an embodiment of the method, locking the second profiles to the first profiles by inserting a locking member through second profiles and each adjusting member into the first profiles.

In an embodiment of the method, locking the second profiles to the first profiles by inserting a locking member through second profiles and into the adjusting members.

In an embodiment of the method, locking the second profiles to the first profiles by inserting a locking member through second profiles and each adjusting member into a locking piece arranged inside the first profile.

In an embodiment of the method, the distance between the first profiles and the second profiles is adjusted by rotating the adjusting member around its central axis.

According to a third aspect, an adjusting member is provided for fastening two façade fastening profiles together and adjusting their positions in relation to each other, comprising an adjusting portion, a flange and an fixing portion arranged sequentially on a central axis, wherein the adjusting portion is installable to the first profile and the fixing portion is installable to the second profile so that the adjusting member is slidable along the first and/or second profile, and movable along its central axis for adjusting the distance between façade fastening profiles.

In an embodiment, the adjusting member is rotatable around its central axis for moving along the central axis and adjusting the distance between the façade fastening profiles.

It is to be understood that the aspects and embodiments of the invention described above may be used in any combination with each other. Several of the aspects and embodiments may be combined together to form a further embodiment of the invention.

BRIEF DESCRIPTION OF THE DRAWINGS

The accompanying drawings, which are included to provide a further understanding of the invention and constitute a part of this specification, illustrate embodiments of the invention and together with the description help to explain the principles of the invention. In the drawings.

DETAILED DESCRIPTION

Figure 1:
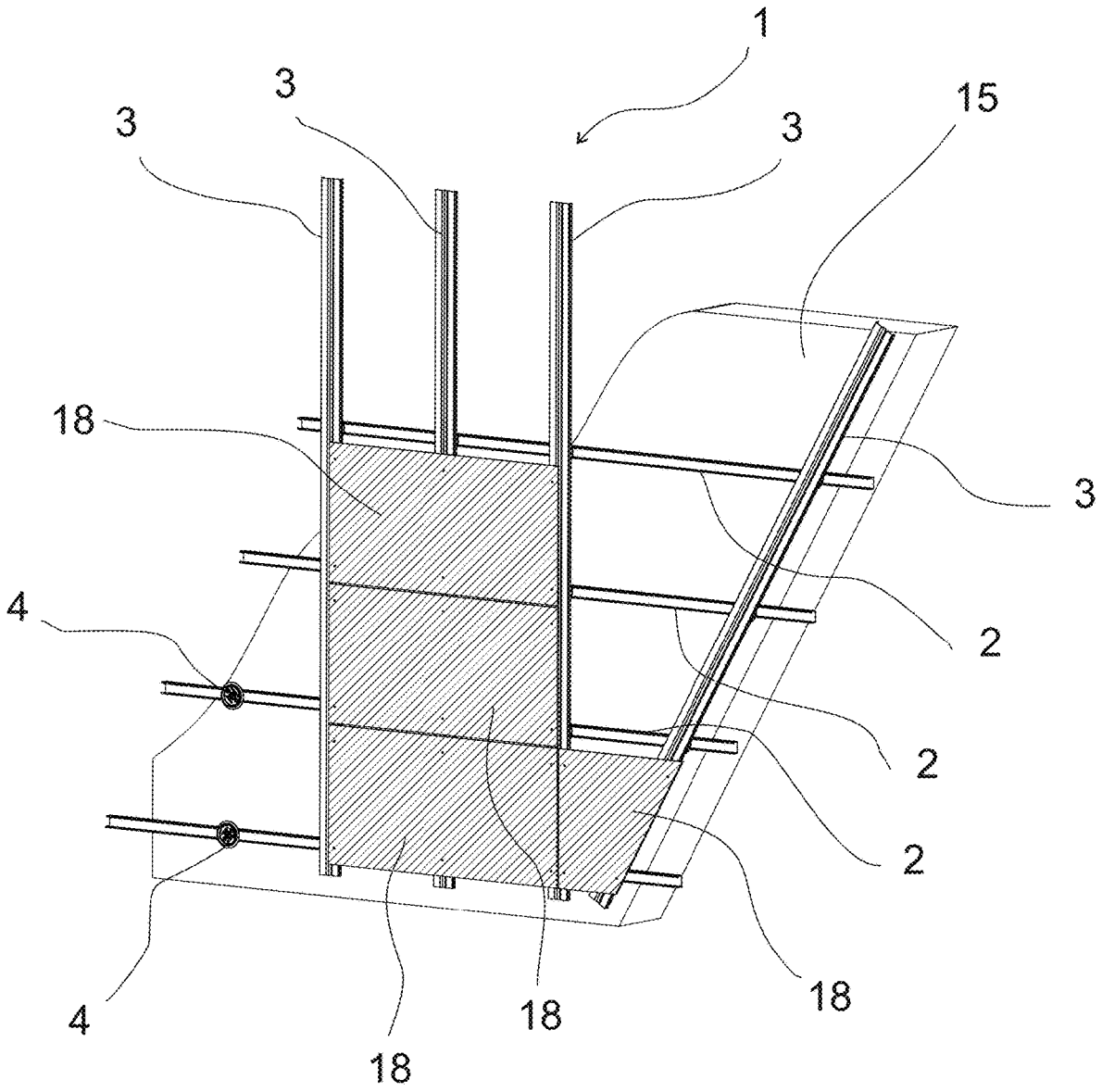
FIG. 1 shows a façade cladding fastening system.

FIG. 1 shows a façade cladding fastening system 1 during an installation process. The cladding may be for example a wood- or fiber-based board, a composite board, metal sheet, high pressure laminate or metal or panel cassette. It may be also timber board or panel and even ceramic tiles.

The system of FIG. 1 comprises four first profiles 2 fastened to the building wall 15. The first profiles 2 are in horizontal position but it is to be noted that the position may vary depending on for example the surface on which they are fastened and the design of the façade claddings 18. The system in FIG. 1 comprises further four second profiles 3 fastened to the first profiles 2. Three of the second profiles 3 are essentially in vertical position and one is inclined compared to the three others. The façade claddings 18 (one in shape of trapezium and three in shape of rectangle) are fastened to the second profiles 3 to form a façade of the building. The number, the shape and the length of the first profiles 2 and the second profiles 3 may vary. Each of the first and second profiles may be formed of one long profile or they may be formed of plurality of shorter profiles.

The second profiles 3 may be fastened on top of the first profiles 2 so that they are in parallel position with the first profiles. However, the second profiles 3 may be fastened to the first profiles 2 in cross-position.

The second profiles 3 are fastened to the first profiles 2 with adjusting members 4. Number of the adjusting members depends on the load of the façade claddings. Typically, but not necessarily, each of cross points of the profiles has one adjusting member 4, which is used for adjusting the position of the second profile 3 in three dimensions. The adjusting member 4 is slidable along the first profile 2 and/or the second profile 3. This allows more flexible assembly of the second profiles as their position may be adjusted along the first profiles.

Figures 2A, 2B, 2C:
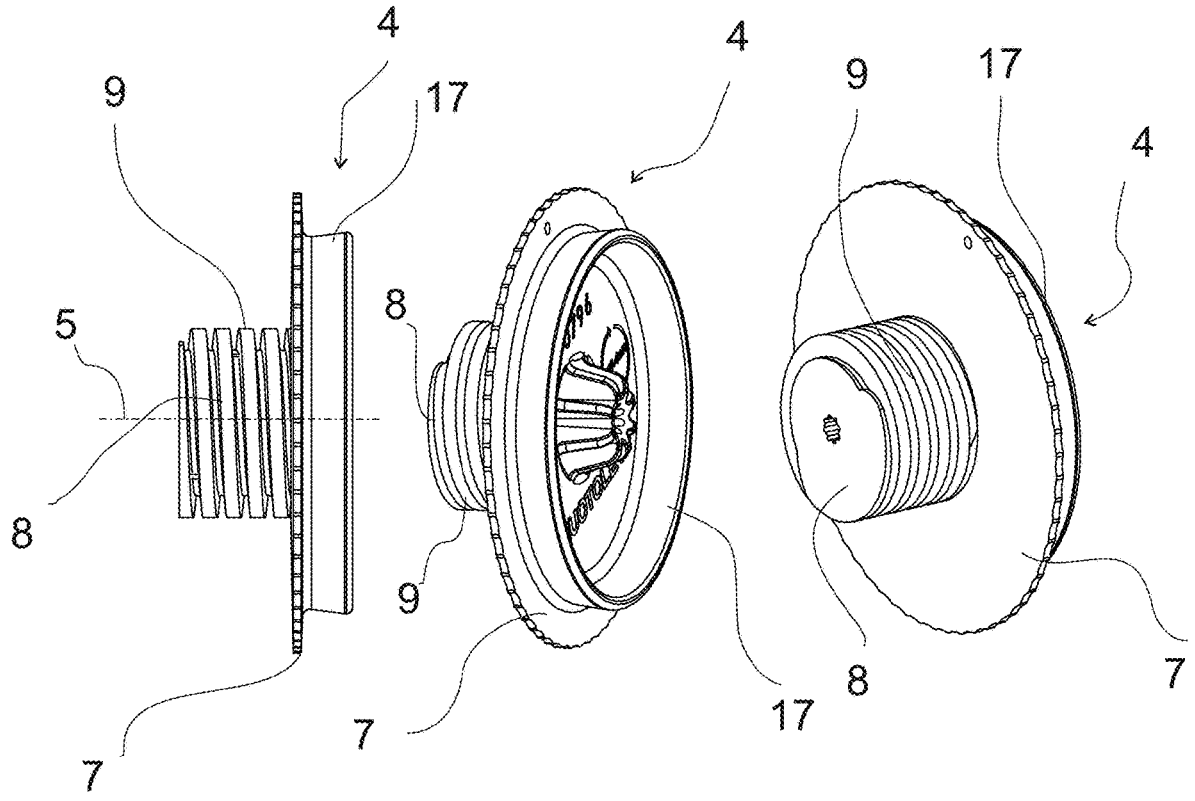
FIGS. 2A-2C show an adjusting member from different views.

FIGS. 2A-2C show the adjusting member 4 from different views. The adjusting member may comprise an adjusting portion 8, a flange 7 and a fixing portion 17 arranged sequentially on a central axis 5. The adjusting portion 8 is installable to the first profile so that the adjusting member 4 may slide along the first profile. The fixing portion 17 may have a shape of a cylinder extending from the flange 7. The fixing portion 17 may be hollow or filled, and it is installable to the second profile so that the adjusting member 4 may slide along the second profile. When the adjusting member 4 is installed to the first and second profile, the flange 7 remains between the profiles and it separates them so that the first and the second profile are not connected. Therefore, it is possible to use a great variety of different materials for the first and second profile, such as metal, wood and plastic. Even different kinds of metals may be used, such as aluminum and steel, as they do not touch each other when the façade is installed properly. However, the first and second profile may be also made of the same material.

The adjusting member 4 may be made of plastic as it has many great properties for said use, such as slidability. The adjusting member 4 may also be made of diecast metal or polymercomposite.

The fixing portion 17 of the adjusting member 4 may have a shape of a truncated cone which diameter grows while extending from the flange 7. By having angular outer surface, the second profile may be fastened to the fixing portion so that there is no need to hold it, i.e. the second profile may be snapped in to the fixing portion 17, and the second profile is still slidable in relation to the adjusting member 4.

According to one embodiment, the adjusting portion 8 comprises threads 9, which are arranged to engage with the first profile and, when the adjusting member 4 is rotated around its central axis 5, to adjust the distance between the first profile and the second profile and, thus, make the façade more even.

According to one embodiment, the adjusting member 4 is moved along its central axis 5 by sliding, wherein the adjusting portion comprises sequential notches or lugs which may engage with the first profile 2. With the notches or lugs, the position of the adjusting member, in relation to the first profile, may be adjusted in perpendicular direction. The distance between the first profiles and the second profiles is adjusted by sliding the adjusting member into and/or out of the first profile between the positions defined by the notches or lugs.

Figure 3:
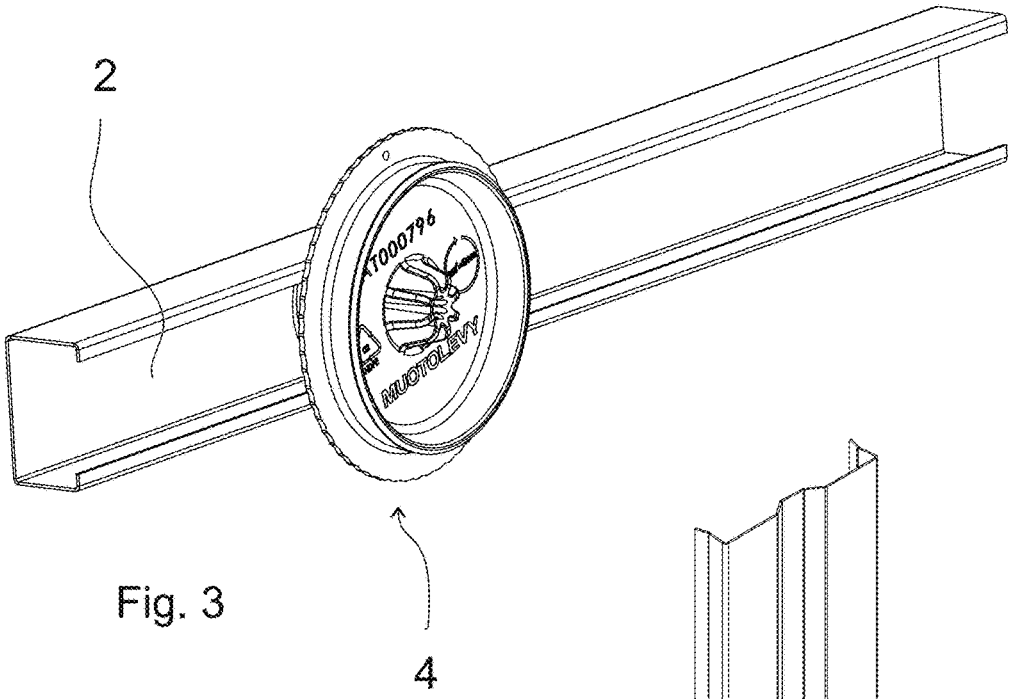
FIGS. 3 shows the adjusting member which is installed to a first profile.

FIG. 3 shows an adjusting member 4 which is installed to the first profile. The diameter of the flange 7 may be greater than the width of the first profile so that the flange 7 will extend outside of the first profile.

Figure 4:
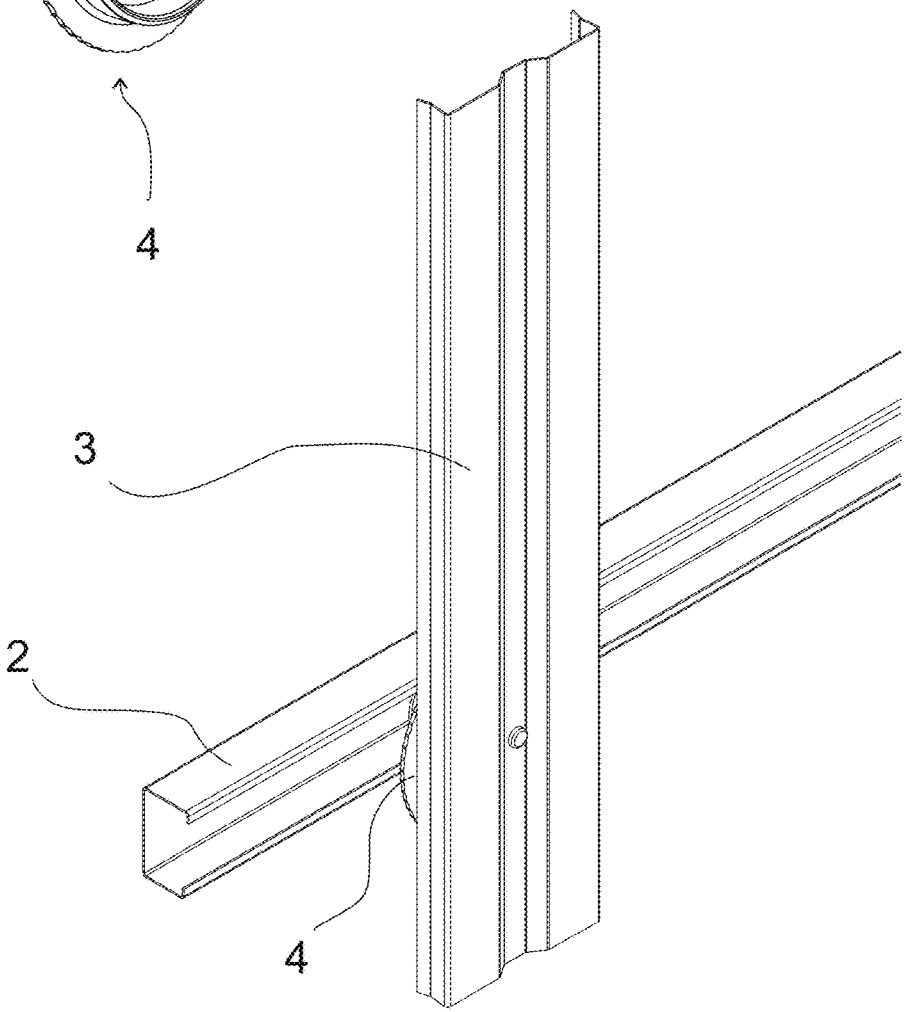
FIGS. 4 shows the same situation as FIG. 3 but a second profile is installed to the adjusting member.

FIG. 4 shows the same situation as FIG. 3 but the second profile is installed to the adjusting member 4 and a locking member is installed to lock the position of the second profile in relation to the first profile. The diameter of the flange 7 extends also outside of the second profile width.

As the flange remains visible after the first and second profile are installed, it is easy to slide or rotate the adjusting member 4 using the flange 7, and to adjust the distance between first and second profile. After the position of the second profile and the distance between the first and second profile is desired, the locking member is installed for locking the position of the second profile and the adjusting member.

Figure 5A:
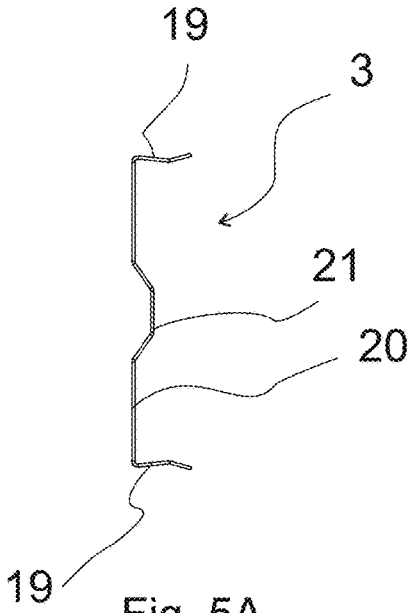
FIGS. 5A-5B show the second profile from different views.
Figure 5B:
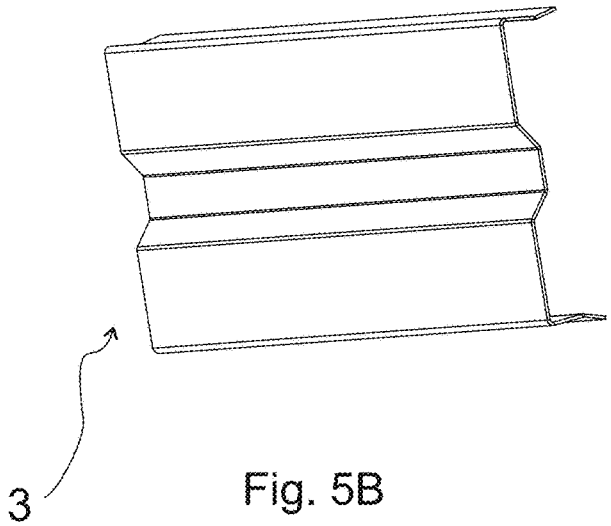

FIG. 5A shows a cross-section of the second profile 3 from the side. FIG. 5B shows overall view of the second profile 3. The second profile may comprise a bottom portion 20 and two side portions 19 extending from the bottom portion. The fixing portion 17 of the adjusting member 4 may be arranged to be installed between the side portions of the second profile and towards the bottom portion. The side portions 19 may be flexible so that second profile may be snapped on the fixing portion 17 of the adjusting member. This is preferred for example if the fixing portion 17 has the shape of truncated cone. The bottom portion 20 may comprise a longitudinal rise 21.

Figure 6A:
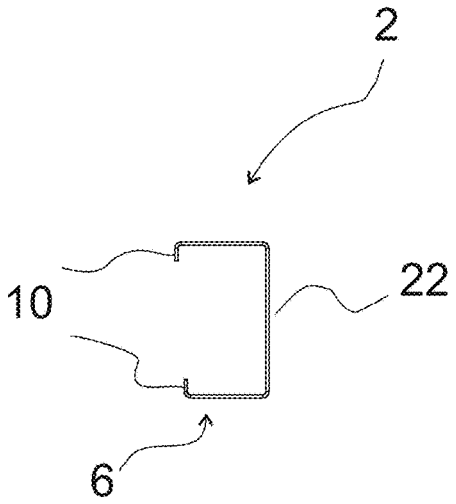
FIGS. 6A-6B show the first profile from different views.
Figure 6B:
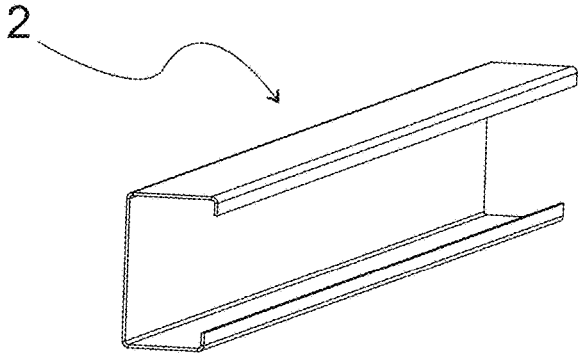

FIG. 6A shows a cross-section of the first profile 2 from the side. FIG. 6B shows overall view of the first profile 2. The first profile 2 may be a c-profile comprising a bottom portion 22 and c-rail portions 6, i.e. two side portions extending from the bottom portion 22. The c-rail portions 6 may further comprise first profile flanges 10 extending from the c-rail portions towards each other. The first profile flanges 10 may be arranged to engage with the threads 9 or notches/lugs of the adjusting member 4, when the adjusting member is installed to the first profile.

One of the c-rail portions 6 may extend further than the other c-rail portion so that the first profile flanges 10 corresponds the rise of the threads in the adjusting member 4.

The first profile 2 may also be a H-profile comprising same kind of bottom portion and c-rails as C-profile above, but it additionally comprises extension flanges extending from the bottom portion in opposite direction from the c-rail portions.

The first profile 2 may be any kind of profile having a bottom portion and c-rail portions as explained above with C-profile.

Figure 7A:
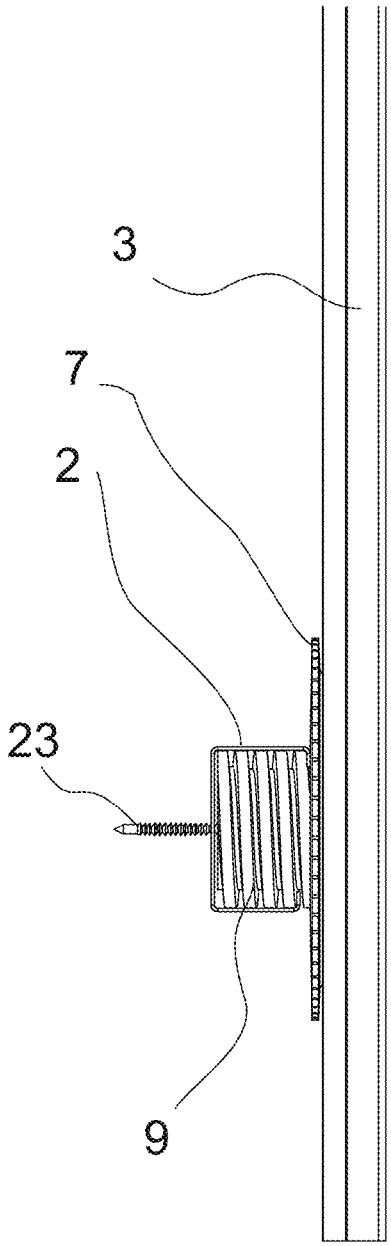
FIGS. 7A-7B show a cross-section of a cross point of the first profile and the second profile when they are installed with the adjusting member at a minimum distance and a maximum distance.
Figure 7B:
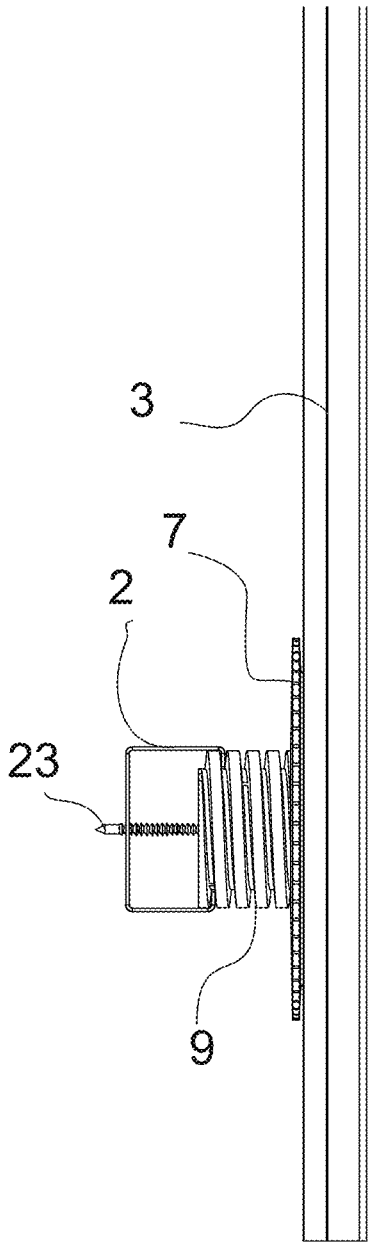

FIGS. 7A and 7B show a cross-section of a cross point of the first profile 2 and the second profile 3 when they are installed with the adjusting member 4 comprising threads 9. In FIG. 7A, the adjusting member is in its lowest position inside the first profile 2 and the flange 7 separates the first and second profile. In FIG. 7B, the adjusting member 4 has been rotated around its central axis 5 causing the threads 9, engaged to the first profile flanges, to rise the adjusting member 4 out of the first profile 2. As the flange 7 is abutting the second profile, it has separated the second profile further from the first profile. This adjustment allows more flexible installation of the façade claddings, as the uneven surface of the building wall needs not any levelling or smoothening before installation. This also allows forming uneven surfaces or different kind of designs for the façade, e.g. angled surface.

When the second profile 3 is in desired position, user may lock the position in relation to the first profile by inserting or installing a locking member 23. The locking member 23 may be used in each cross point of the first profile and the second profile in which an adjusting member 4 is provided.

In an embodiment, the locking member is inserted/installed through the second profile 3 into the adjusting member 4, which locks the position in relation to the first profile 2.

In an embodiment, the locking member 23 is inserted/installed through the second profile and through the adjusting member into the first profile. The same locking member may also be inserted through the first profile into to the wall.

In an embodiment, the first profile comprises a separate locking piece, which is arranged inside the first profile, i.e. against the inner surface of the first profile, and the locking member 23 is inserted/installed through the second profile and through the adjusting member into the locking piece.

The locking member 23 may be for example a plug, screw, nail or bolt.

Figure 8:
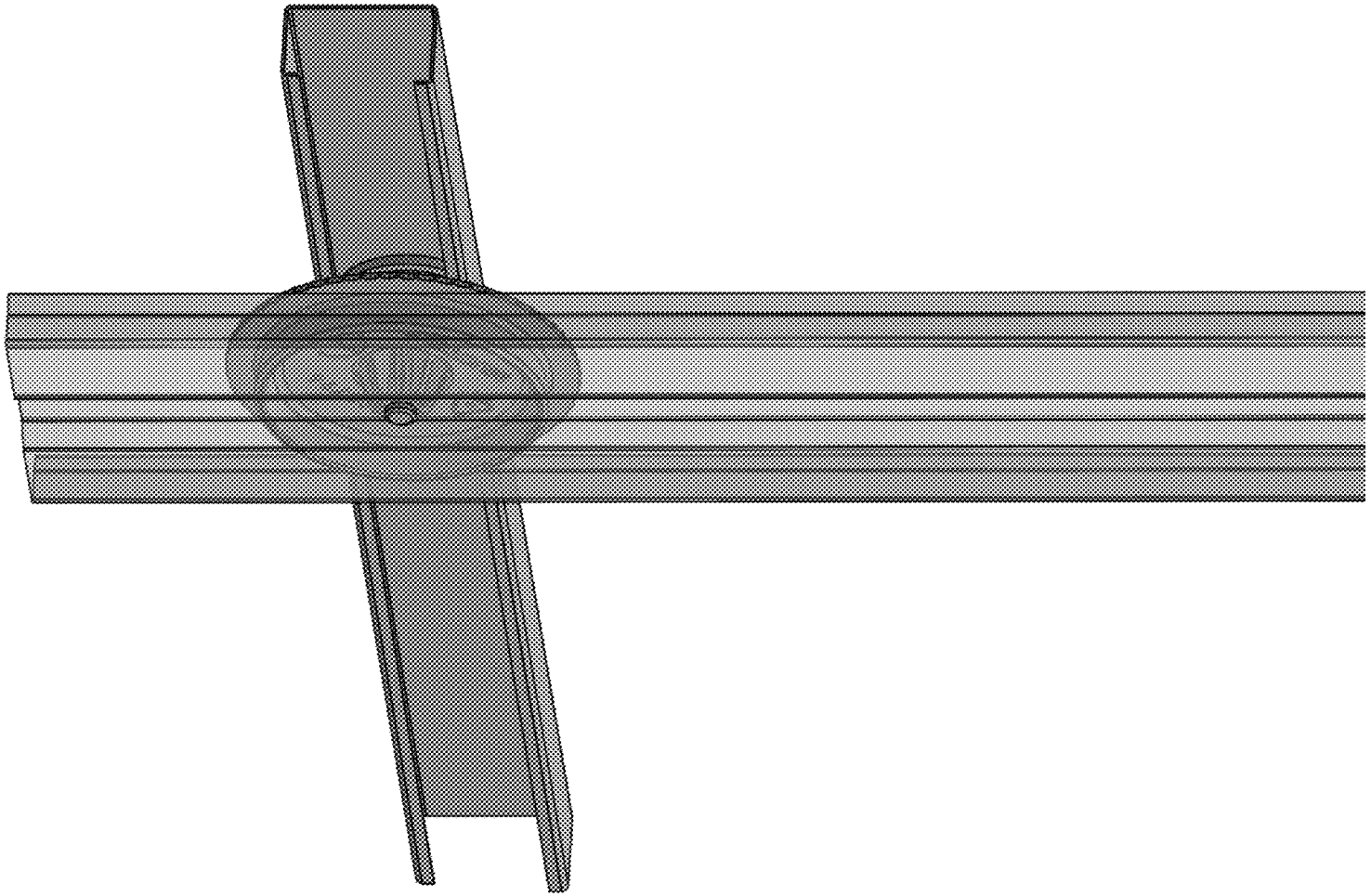
FIGS. 8 shows an overview of the fastening system.

FIG. 8 shows a fastened second profile 3, which is partly transparent to show the fastening more clearly.

Figure 9A:
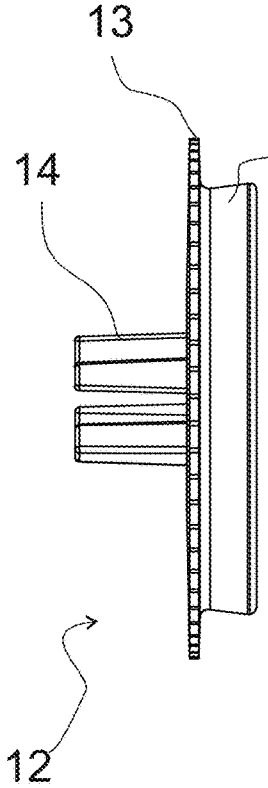
FIGS. 9A-9C show a spacer from different views.
Figure 9B:
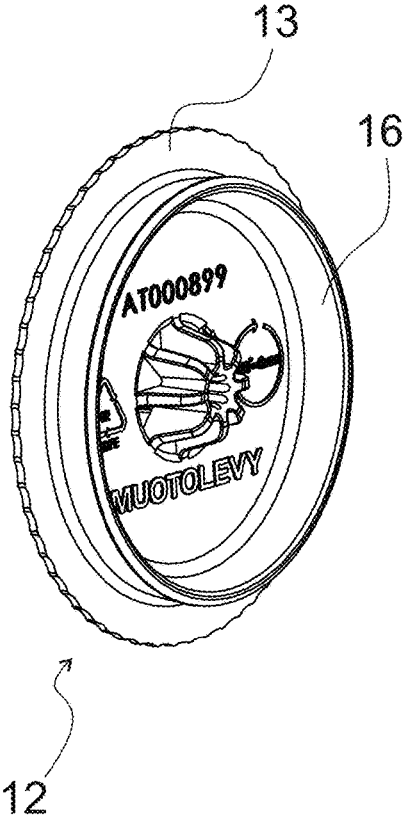
Figure 9C:
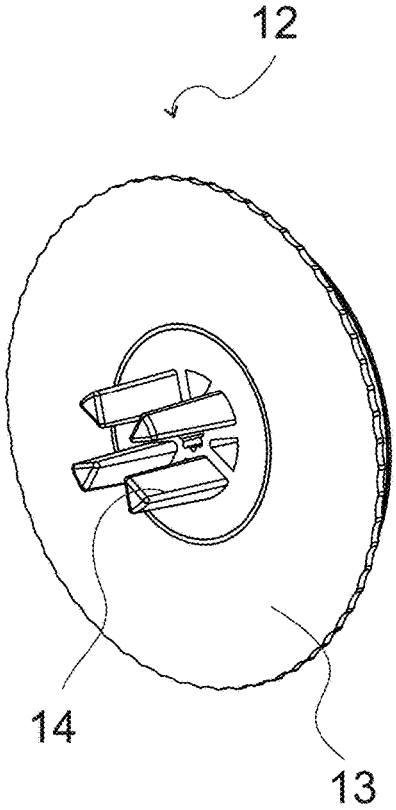

FIGS. 9A-9C shows a spacer 12 for the façade fastening system. As the adjusting portion 8 of the adjusting member 4 usually corresponds the depth of the c-rail portion of the first profile, the distance between the first profile 2 and the second profile 3 may be limited by the length of the adjusting portion 8. However, sometimes the second profile 3 needs to be installed even further from the first profile 2. To adjust the second profile 3 even further from the first profile 2, a spacer 12 may be installed between the adjusting member 4 and the second profile 3.

The design of the spacer 12 may correspond the design of the adjusting member 4 without the adjusting portion 8, which is replaced by a base portion 14. The base portion 14 extends from a flange portion 13 and, in use, towards the adjusting member 4. The spacer 12 may be locked to the adjusting member 4 by pushing it towards the adjusting member 4 whereby the base portion 14 engages with the adjusting member. The base portion 14 may comprise several parts extending from a flange portion 13, which are configured to engage with the adjusting member 4. A protrusion 16 is arranged to extend from the flange portion 13 in opposite direction than the base portion 14. The protrusion 16 may have a shape of cylinder, and it is arranged to be installed to the second profile 3 same way as the fixing portion 17 of the adjusting member 4 and it is slidable along the second profile 3. The protrusion 16 may have also a shape of truncated cone. The spacer 12 may be fastened to the first and second profile by the same locking member as the adjusting member.

In an embodiment, the spacer comprises an adjusting portion, like the adjusting member, having outer threads and the fixing portion 17 of the adjusting member comprises corresponding inner threads. The spacer may be engaged to the adjusting portion by said threads.

In an embodiment, the protrusion of the spacer comprises inner threads which correspond to the outer threads of the adjusting portion of another spacer.

Figure 10:
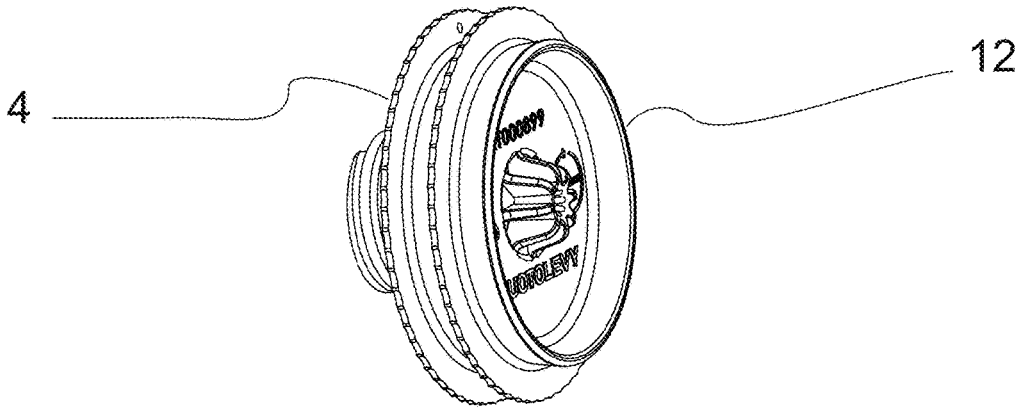
FIG. 10 shows the spacer fastened to the adjusting member.

FIG. 10 shows an adjusting member 4 and a spacer 12 engaged to each other before they are fastened to the first profile 2 and before the second profile 3 is fastened to the spacer 12.

According to an embodiment, the façade fastening system comprises several spacers 12 arranged between the adjusting member 4 and the second profile 3. The spacer may be fastened to the adjusting member and/or to another spacer by a snap-on connection or by threads.

Although the invention has been the described in conjunction with a certain type of device, it should be understood that the invention is not limited to any certain type of device. While the present inventions have been described in connection with a number of exemplary embodiments, and implementations, the present inventions are not so limited, but rather cover various modifications, and equivalent arrangements, which fall within the purview of prospective claims.

What is claimed is:

1. A façade cladding fastening system comprising, at least two first profiles arranged to be fastened to a wall of a building, at least two second profiles fastened to the first profiles, wherein the second profile is fastened to the first profile with an adjusting member comprising an adjusting portion, a flange and an fixing portion arranged sequentially on a central axis which is perpendicular to the first and second profiles, is configured to slide along the first profile and/or the second profile for adjusting the position of the second profile in relation to the first profile, and move along its central axis for adjusting the distance between the first and the second profile.

2. The façade cladding fastening system according to claim 1, wherein the first profile comprises a C-rail portions extending towards the second profile.

3. The façade cladding fastening system according to claim 1, wherein the adjusting member comprises a flange provided between the first and second profile.

4. The façade cladding fastening system according to claim 2, wherein the adjusting member comprises an adjusting portion having threads engaged with first profile flanges of the C-rail portions of the first profile, and it is configured to move along a central axis of the adjusting member when it is rotated around the central axis.

5. The façade cladding fastening system according to claim 1, wherein the adjusting member is made of plastic.

6. The façade cladding fastening system according to claim 1, wherein the first profile and the second profile are made of different material.

7. The façade cladding fastening system according to claim 1, wherein the first and second profile are made of metal.

8. The façade cladding fastening system according to claim 1, wherein the position of the second profile is locked in relation to the first profile by a locking member configured to be installed through the second profile into the adjusting member, or through the second profile and through the adjusting member into the first profile.

9. The façade cladding fastening system according to claim 1, wherein at least one spacer is arranged between the adjusting member and the second profile, wherein the spacer comprises a flange portion, arranged to support the second profile, and a base portion, engaged with the adjusting member.

10. A method for fastening a façade cladding to a wall of a building with a system according to claim 1, comprising steps of:

fastening at least two first profiles to the wall of the building, engaging adjusting members to the first profile, fastening with the adjusting members at least two second profiles to the first profiles, adjusting the position of the second profiles in relation to the first profiles by sliding the adjusting members along the first profiles, adjusting the distance of the second profiles from the first profiles by moving the adjusting member along its central axis fastening at least one façade cladding to the second profiles.

11. The method according to claim 10, wherein locking the second profiles to the first profiles by installing a locking member through the second profile into the adjusting member, through the second profile and through the adjusting member into the first profile, or through the second profile and through the adjusting member into a locking piece arranged inside the first profile.

12. The method according to claim 10, wherein the distance between the first profiles and the second profiles is adjusted by rotating the adjusting member around its central axis.

13. An adjusting member for fastening two façade fastening profiles together and adjusting their positions in relation to each other, comprising an adjusting portion, a flange and an fixing portion arranged sequentially on a central axis, wherein the adjusting portion is installable to a first profile and the fixing portion is installable to a second profile so that the adjusting member is slidable along the first and/or second profile, and movable along its central axis for adjusting the distance between façade fastening profiles.

14. The adjusting member according to claim 13, wherein the adjusting portion is threaded and rotatable around its central axis for moving along the central axis and adjusting the distance between the façade fastening profiles.

15. The adjusting member according to claim 13 has an aperture extending along the central axis sized to receive an elongate locking member therethrough.

16. The façade cladding fastening system according to claim 1, wherein the adjusting member has an aperture extending along the central axis sized to receive an elongate locking member therethrough.

* * * * *